United States Patent [19]

Piantedosi

[11] Patent Number: 4,649,852

[45] Date of Patent: Mar. 17, 1987

[54] ROWING ATTACHMENT FOR A CANOE OR THE LIKE

[76] Inventor: Gary G. Piantedosi, 257 Arlington St., Action, Mass. 01720

[21] Appl. No.: 882,191

[22] Filed: Jul. 2, 1986

Related U.S. Application Data

[63] Continuation of Ser. No. 597,345, Apr. 6, 1984, abandoned.

[51] Int. Cl.[4] ..... B63H 16/067

[52] U.S. Cl. ..... 114/363; 114/347; 440/105

[58] Field of Search ..... 440/104, 105, 106; 114/347, 363

[56] References Cited

U.S. PATENT DOCUMENTS

| | | | |
|---|---|---|---|
| 300,895 | 6/1884 | Rettig | 440/105 |
| 2,557,972 | 6/1951 | Jewett | 440/105 |
| 3,898,950 | 8/1975 | Martin | 115/24.1 |

FOREIGN PATENT DOCUMENTS

| | | | |
|---|---|---|---|
| 3016857 | 11/1981 | Fed. Rep. of Germany | 440/105 |
| 3019514 | 11/1981 | Fed. Rep. of Germany | 440/105 |

OTHER PUBLICATIONS

Oarmaster, "Add to Your Life with Exercise", Martin Marine Company, Inc.

Rowing, U.S.A., "Oarmaster", Aug. 1983, p. 38.

Mad River Canoe, 1982, Waitsfield, Vt.

The Silver Fox, Nov. 1983, New Smyma Beach, Fla.

ReGraham Corporation, "Introducing the Trimline", Orange, Calif.

*Primary Examiner*—Trygve M. Blix

*Assistant Examiner*—Thomas J. Brahan

*Attorney, Agent, or Firm*—Rines and Rines, Shapiro and Shapiro

[57] ABSTRACT

A rowing attachment for a canoe or similar boat having, in combination, a seat-carrying longitudinal support extending a substantial distance along the longitudinal axis of the canoe; foot means disposed near the ends of the support and depending below the same for resting the support at its ends above the bottom of the canoe; outrigger wings extending symmetrically transversely of the support from an intermediate region thereof over the gunnels of the canoe and laterally to the sides thereof, said wings supporting oarlocks near their free ends and being provided in the region where they pass over the gunnels with depending adjustable clamps for securing the wings to the gunnels, thereby securing the attachment within the canoe resting upon said foot means at the ends of the longitudinal support and providing additional structural integrity to the wings.

16 Claims, 4 Drawing Figures

ROWING ATTACHMENT FOR A CANOE OR THE LIKE

This is a continuation application of Ser. No. 597,345 filed Apr. 6, 1984, now abandoned.

The present invention relates to rowing mechanisms for ready attachment to and removal from canoes, shells, sail and other boats, or simulated rowing or exercise platforms or the like, hereinafter sometimes generically referred to as a canoe or the like.

BACKGROUND OF THE INVENTION

Racing and rowing shells are often provided with a removable rowing apparatus commonly comprising a base having a track, a seat slidable fore and aft on the track and a pair of riggers extending from the base out over the gunnels of the shell, with oar locks being mounted on the ends of the riggers. Numerous similar devices have been devised to insert within or attach to canoes, boats or other shells to convert those boats to rowing boats, the attachments providing a rowing seat or seats, sometimes footrests and some mechanisms for oar locks for the rowing user.

Generally, these devices involve supporting structures that rest on frames upon the bottom of the canoe or other boat and thus require the securing of the frame to the boat bottom in some manner. The "Oar Master" attachment for a sliding seat described in U.S. Pat. No. 3,898,950 and on page 38 of Rowing, U.S.A., August, 1983, is such a device with outrigger wings or arms for stabilizing purposes and for carrying the oarlocks and with the free ends laterally extending to the wings. A difficulty with such a form of stabilizing is the necessity for securing the support frame to the bottom of the boat and the instability in the freely extending outrigger wings.

Similarly the rowing rig as described in the 1982 catalogue of Mad River Canoe Company, Waitsfield, Vt., attaches to the canoe by means of aluminum beams expanded and secured into the hull of the canoe by pins, the pins remaining permanently affixed to the canoe. Additionally, this rowing rig device has no stabilizing mechanism.

Another example is the sculling attachment for canoes described in the November, 1983 brochure of Silver Fox, New Smyma Beach, Fla., where rubber strips are cemented to the bottom of the boat and the rowing device attachment is placed thereupon. Similar constructions, again requiring a permanent securing mechanism are described in the ReGrahm Corporation, Orange, Calif. flier of the "Trimline."

The present invention, on the other hand, entirely eliminates the need for permanent attachment to the bottom or sides of a canoe, skiff, boat or shell or the like, as well as any requirement whatsoever for the permanent attaching devices such as rubber strips, pins or other special mechanisms associated with the installation of prior devices. In addition, with the present invention, considerable structural integrity and stability are imparted to outrigger wing attachments and to the canoe or other boat itself, both for securing the attachment in place in the boat and for providing improved structural integrity of the outrigger wing structure. The present invention is also capable of supporting both fixed and slidable seats, which are movable during rowing as in sculling, and may be adapted for multiple seats to accommodate a plurality of rowers, if desired.

It is accordingly an object of the present invention to provide a new and improved rowing attachment for a canoe or similar boat that shall not be subject to the above-described limitations of prior systems, but that, to the contrary, enables installation in a canoe or similar boat without requiring the installation of permanent attachment or supporting means.

A further object is to provide such a novel rowing apparatus that provides considerable structural integrity and stability to the outrigger wing attachments of the rowing attachment and to the canoe itself.

An additional object is to provide a rowing apparatus that can support single or multiple seats that may be either fixed or slidable during rowing.

Other and further objects are explained hereinafter and are more particularly delineated in the appended claims.

SUMMARY OF INVENTION

In summary, however, from one of its important aspects, the invention embraces a rowing attachment for a canoe or the like having a longitudinal support extending a substantial distance along the longitudinal axis of the canoe and supporting a seat for the user; foot means disposed near each of the ends of the support and depending below the same for resting the support at its ends above the bottom of the canoe; outrigger wings extending symmetrically transversely of the support from an intermediate region thereof over the gunnels of the canoe and laterally to the sides thereof, said wings supporting oarlocks near their free ends and being provided in the region where they pass over the gunnels with depending adjustable clamps for securing the wings to the gunnels, thereby securing the attachment within the canoe, firmly resting upon said foot means at ends of the longitudinal support and providing additional structural integrity to the wings at the gunnels. Preferred details and other features are hereinafter set forth.

DRAWINGS

The invention will now be described in connection with the accompanying drawings:

FIG. 1 of which is an elevated rear view of a preferred form of the invention attached to a canoe;

DESCRIPTION OF INVENTION

Figure 1:
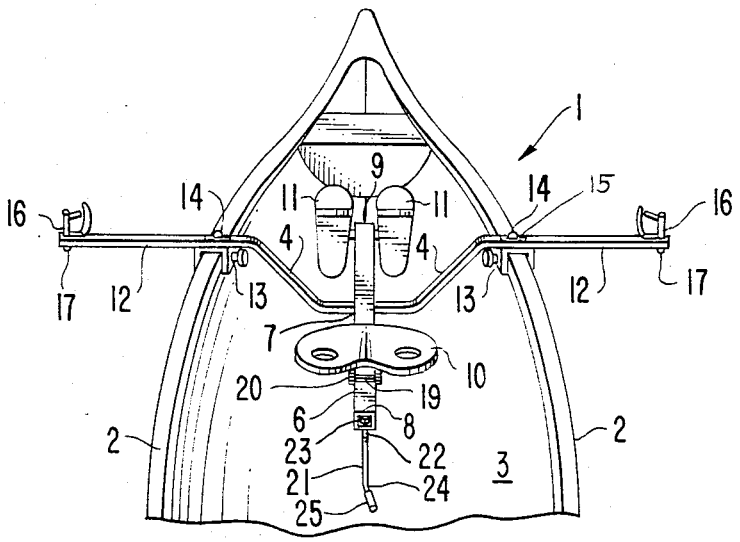
Figure 2:
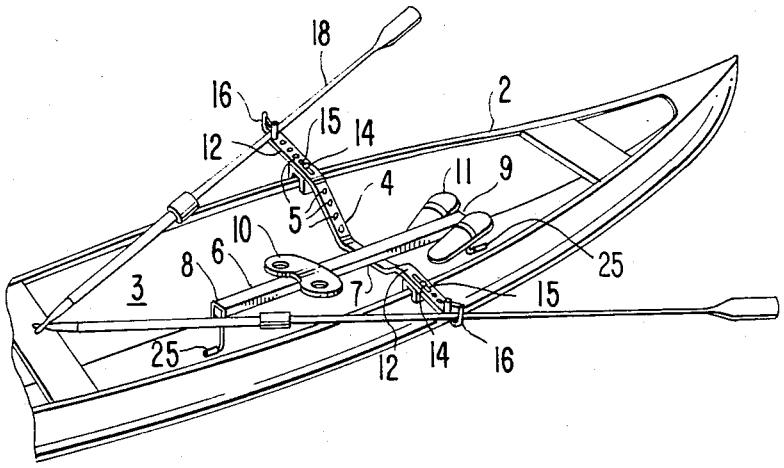
FIG. 2 is an elevated rear-side view similar to FIG. 1 showing placement of oars in locks.
Figure 3:
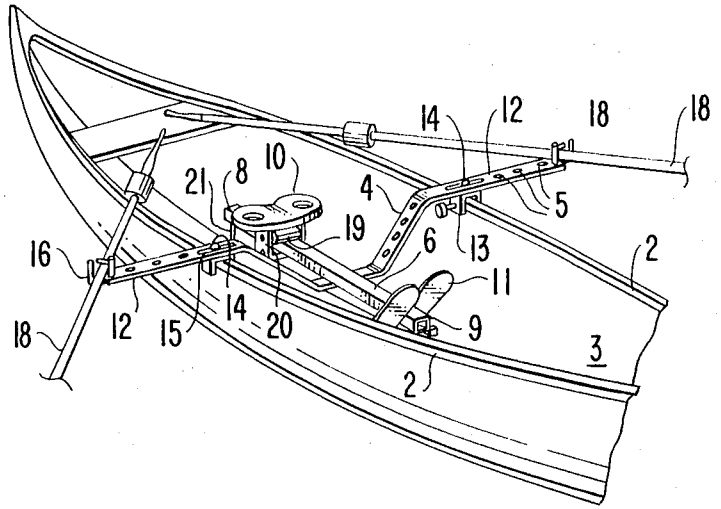
FIG. 3 is an elevated front-side view similar to FIG. 2.

Referring to FIGS. 1, 2 and 3 wherein like numerals refer to like structures, the rowing attachment for a canoe or the like is shown generally at 1, constructed in accordance with a preferred embodiment of the present invention. The rowing attachment 1 is adapted to be readily and simply attached to and removed from a pair of gunnels 2 of a canoe 3 or the like, as will be described in more detail hereinafter, without the requirement of any alteration to the canoe or any permanent attaching mechanisms, and without leaving any residual evidence of the previous attachment of the structure, once removed.

The rowing attachment 1 is constructed in the form of a longitudinally extending support 6, such as a hollow square or rectangular cross-section tube or bar of rigid material, such as steel, intermediately provided with and carrying at its neck a U-shaped transversely extending support section 4, the arms of which terminate in outwardly extending outrigger wings 12. The section 4 may be lightened by introducing holes 5 to a degree that still preserves the structural integrity of the frame attachment 6,4,12.

The bar support 6 is provided at or near its front end 9 and its rear end 8 with depending feet 21–25. The feet support the bar 6 along the longitudinal axis of the canoe or the like, inboard and centered between the gunnels 2 of the canoe and spaced above the canoe bottom, resting thereupon only at the forward and rearward portions 25 of the feet. The support bar 6 is adapted to receive along its upper surface a seat 10 for a rower, shown attached nearer the rearwardly disposed end 8 in a manner later described in detail; and a pair of footrests 11 of any acceptable configuration is securely attachable, as by bolts, to the bar 6 near the forwardly disposed end 9.

Figure 4:
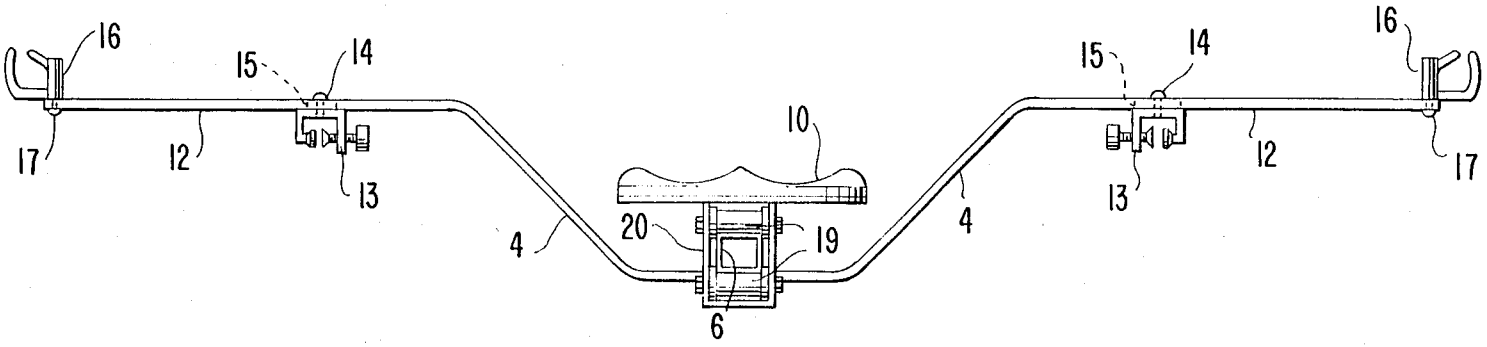
FIG. 4 is a transverse cross-sectional view, facing rearward of the apparatus.

With the U-shaped internal transverse section 4 secured substantially mid-way along the support bar 6 and transversely extending upwardly to opposite points of the gunnels 2, the before-mentioned outboardly extending outrigger wing members 12 extend symmetrically over the gunnels 2 of the canoe 3 laterally to the sides thereof, preferably substantially horizontally. In the preferred embodiment shown in FIGS. 1, 2 and 3, the wings 12 are constructed as one piece with the section 4 and are attached to the gunnels 2 by brackets, such as C-clamps 13, more particularly shown in FIGS. 1 and 4, which may be padded to avoid damaging the gunnels 2. The clamps 13 are shown adjustably moveable by bolts 14 extending within slots 15 along the wings 12 to accommodate different width dimensions of the canoe; and when attached to the gunnels 2, the clamps provide rigid support of the rowing apparatus 1 within the canoe 3 and substantial outrigger stabilization.

The outboard wings 12 are provided with oar-holding devices, shown as oar locks 16, near the outermost portions thereof that are rotatably attached to the wings 12, as by bolts 17, to enable rowing with oars 18 inserted into oarlocks 16, as seen in FIGS. 2 and 3. Additionally, the standard open construction of the oarlocks 16 allows for upward and downward movement of the oars 18 while held in the oarlocks 16 to facilitate normal rowing operation.

While a fixed seat arrangement can readily be achieved by fixedly securing the seat to the support bar 6 in any convenient location along the length of the support bar, as by a threaded nut and bolt arrangement (not shown), it may be desirable in practice to employ a slidable seat, movable during rowing, as in sculling. Such a seat may be movably attached to the support bar 6 with the aid of a roller mounting slidable along the length of the bar 6, as by spindles 19 (FIGS. 1, 3 and 4) held in fixed relationship substantially surrounding a portion of the bar 6 by a rigid bracket assembly 20; the bracket, in turn, being attached to or an integral part of the seat 10, as more particularly shown in FIG. 4.

Referring now to FIGS. 1, 2 and 3, the support resting foot means 21–25 depending below each of the forwardly disposed end 9 and the rearwardly disposed end 8 of the the support bar 6 and holding the same along the longitudinal axis of the canoe and above the canoe bottom, are shown. The foot means are constructed of vertical support rods 21 having upper threaded ends 22 that extend into threaded nuts 23 in the support bar 6, and bottom resting foot portions 25, such as longitudinally extending bends in the bottom ends 24 of the vertical foot supports 21. If desired, padded or resilient resting members, such as rubber feet or the like, may be employed on resting foot portions 25 to minimize the possible puncturing or other damaging of the canoe when weight is applied to the support bar 6 by a rower sitting in the seat 10. The bottom support portions 25 may also conveniently act as handlegs to facilitate turning the rods 21 along their respective axes easily to facilitate height adjustment of the attachment 1 by varying the threaded height adjustment of rods 21 in conjunction with the adjustable nuts 23.

The resulting combination of the transverse and lateral support provided by the clamps 13 attached to the gunnels 2 of the canoe 3, the weight-bearing properties provided by the rigid support sections 6-4 and clamps 13 transmitting the downward weight forces are transmitted to the gunnels 2, and the longitudinal stability and additional weight support provided by the support bar 6 as its bottom support feet 21–25 contact the bottom of the canoe 3, provides a rigid structure 1 for withstanding the forces and mechanical moments involved in a rower's use of the same in the canoe or the like.

It should be noted that a plurality of seats 10 can be accommodated in a single boat either by attaching a plurality of individual rowing attachments 1 to the same or by elongating the support bar 6 and attaching additional seats 10, corresponding U-shaped supports and outboard wing members 12. Additional intermediate resting support rods 21, footrests, etc. may also be employed.

Further modifications will also occur to those skilled in the art, and such are considered to fall within the spirit and scope of the invention as defined in the appended claims.

What is claimed is:

1. A rowing attachment for a canoe or the like, comprising a longitudinal support having sufficient length to extend a substantial distance along the longitudinal axis of a canoe and supporting a seat for a user; foot means disposed near forward and rear ends of the support and depending below the same for resting on the bottom of the canoe and holding the support above the bottom of the canoe; outrigger wings connected to an intermediate region of the support and extending symmetrically transversely thereof, said wings being dimensioned lengthwise to extend over the gunnels of the canoe and laterally to the sides thereof; oarlocks supported on said wings near respective free ends thereof; and adjustable clamp means depending from each of said wings, respectively, for securing the wings to the gunnels, said clamp means constituting the sole means for securing said rowing attachment to said canoe, whereby when said clamp means are secured, the attachment is secured within the canoe, firmly resting upon said foot at the ends of the longitudinal support, with the secured clamp means stabilizing the wings at the gunnels.

2. A rowing attachment as claimed in claim 1 and in which said seat is provided underneath with a roller mounting slidable along the longitudinal support during rowing use.

3. A rowing attachment as claimed in claim 2 and in which user foot rests are connected near the forward end of the longitudinal support.

4. A rowing attachment as claimed in claim 1 and in which the outrigger wings are secured to the longitudinal support by an internal U-shaped section, the neck of the U-shaped section being secured to the support.

5. A rowing attachment as claimed in claim 1 and in which the clamp means are adjustable along the respective wings to accommodate different canoe dimensions.

6. A rowing attachment as claimed in claim 1 and in which the foot means are height-adjustable to accommodate canoes of different dimensions.

7. A rowing attachment as claimed in claim 6 in which the foot means are threadedly adjustable in height and have bottom extensions that may act also as handles for facilitating threaded height adjustments.

8. In combination, a canoe or the like and a rowing attachment therefor, said rowing attachment comprising: a longitudinal support freely received within the hull of said canoe or the like and extending a substantial distance along the axis thereof, said support having a seat for a user mounted thereon; foot means depending downwardly from said support near front and rear ends thereof, said foot means resting on and holding said support above the bottom of said canoe or the like; outrigger wings connected to an intermediate region of said support and extending symmetrically transversely thereof over the gunnels of said canoe or the like; oarlocks supported on said wings near respective free ends thereof; and clamp means depending from each of said wings and securing said wings to the gunnels, said attachment being secured to said canoe solely by said clamp means, firmly resting upon said foot means with the secured clamp means stablilizing said wings at the gunnels.

9. The combination of claim 8, wherein said foot means rest non-attachably upon the bottom of said canoe or the like.

10. The combination of claim 8, wherein said outrigger wings are secured to said support by a U-shaped section having opposite ends connected to said wings and a neck secured to said support.

11. The combination of claim 8, wherein said clamp means are positionable adjustable along said wings.

12. The combination of claim 8, wherein said foot means are height adjustable.

13. The combination of claim 12, wherein said foot means include thread means for effecting height adjustment thereof.

14. The combination of claim 12, wherein said foot means comprise at least one substantially right angular member having one leg with a free end threadably connected to said longitudinal support and another end resting on the bottom of said canoe or the like.

15. The combination of claim 8, wherein said seat is mounted on said support by a roller mounting slidable along said support.

16. The combination of claim 15, wherein said support has a foot rest mounted near said front end thereof.

* * * * *